US007301268B2

(12) United States Patent
Kang et al.

(10) Patent No.: US 7,301,268 B2
(45) **Date of Patent: *Nov. 27, 2007**

(54) FIELD EMISSION DISPLAY HAVING EMITTER ARRANGEMENT STRUCTURE CAPABLE OF ENHANCING ELECTRON EMISSION CHARACTERISTICS

(75) Inventors: Jung-Ho Kang, Yongin (KR); Yong-Soo Choi, Seoul (KR); Sung-Hwan Jin, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/754,669

(22) Filed: Jan. 12, 2004

(65) Prior Publication Data

US 2004/0140756 A1 Jul. 22, 2004

(30) Foreign Application Priority Data

Jan. 14, 2003 (KR) ..... 10-2003-0002412

(51) Int. Cl.
*H01J 1/30* (2006.01)
*H01J 1/304* (2006.01)
*H01J 19/02* (2006.01)

(52) U.S. Cl. ..... 313/495; 313/310; 313/311; 313/496; 313/497

(58) Field of Classification Search ..... 313/309–311, 313/351, 346 R, 336, 495–497; 445/49
See application file for complete search history.

(56) References Cited

U.S. PATENT DOCUMENTS 3,755,704 A * 8/1973 Spindt et al. ..... 313/309
3,789,471 A 2/1974 Spindt et al. ..... 29/25.17
5,012,482 A * 4/1991 Gray ..... 372/74
5,315,206 A * 5/1994 Yoshida ..... 313/306
5,382,867 A * 1/1995 Yuji et al. ..... 313/309
6,023,125 A * 2/2000 Yoshikawa et al. ..... 313/310
6,062,931 A 5/2000 Chuang et al. ..... 445/24
6,097,138 A 8/2000 Nakamoto ..... 313/309
7,245,067 B2 * 7/2007 Lee et al. ..... 313/310
7,279,830 * 10/2007 Lee et al. ..... 313/497
2003/0067259 A1 * 4/2003 Nishimura ..... 313/310
2005/0189870 A1 * 9/2005 Lee et al. ..... 313/497
2005/0194880 A1 * 9/2005 Moon ..... 313/311
2005/0258730 A1 * 11/2005 Lee et al. ..... 313/310

OTHER PUBLICATIONS

U.S. Appl. No. 11/130,103 (Lee et al.), filed May 17, 2005.*
U.S. Appl. No. 11/068,067 (Lee et al.), filed Feb. 26, 2005.*

* cited by examiner

*Primary Examiner*—Mariceli Santiago
(74) *Attorney, Agent, or Firm*—Stein, McEwen & Bui, LLP

(57) ABSTRACT

A field emission display includes a first substrate, at least one gate electrode formed on the first substrate, cathode electrodes formed on the first substrate, an insulation layer formed between the at least one gate electrode and the cathode electrodes, emitters electrically contacting the cathode electrodes, and formed in pixel regions of the first substrate, counter electrodes electrically connected to the at least one gate electrode and provided such that the counter electrodes and emitters have a first predetermined gap therebetween, a second substrate provided opposing the first substrate with a second predetermined gap therebetween, wherein emitter-receiving sections are provided in the cathode electrodes, dividers are formed between the emitter-receiving sections, the emitters are electrically contacted with an edge of the cathode electrodes corresponding to a shape of the emitter-receiving sections, and at least a part of each of the counter electrodes is provided within the corresponding emitter-receiving sections.

36 Claims, 14 Drawing Sheets

FIELD EMISSION DISPLAY HAVING EMITTER ARRANGEMENT STRUCTURE CAPABLE OF ENHANCING ELECTRON EMISSION CHARACTERISTICS

CROSS-REFERENCE TO RELATED APPLICATIONS

This application claims the benefit of Korean Application No. 2003-2412 filed Jan. 14, 2003, in the Korean Intellectual Property Office, the disclosure of which is incorporated herein by reference.

BACKGROUND OF THE INVENTION

1. Field of the Invention

The present invention relates to a field emission display, and, more particularly, to a field emission display having carbon nanotube emitters.

2. Description of the Related Art

The field emission display (FED) uses cold cathodes as the source for emitting electrons to realize images. The overall quality of the FED depends on the characteristics of emitters, which form an electron-emitting layer. The first FEDs utilized emitters made mainly of molybdenum (Mo), that is, the emitters were formed of what are referred to as Spindt-type metal tips. As an example of such conventional technology, a display system that has field emission cathodes is disclosed in U.S. Pat. No. 3,789,471.

However, during the manufacture of the FED having metal tip emitters, a semiconductor manufacturing process is used, such as photolithography and etching processes to form holes into which emitters are provided and the process of depositing molybdenum to form metal tips. Not only is production complicated and a high technology is needed, but expensive equipment is also required, thereby increasing overall unit costs. These factors make the mass production of such FEDs problematic.

Accordingly, a great deal of research and development is being performed by those in the FED industry to form emitters that enable electron emission at low voltages (10~50V) and simple manufacture of the emitter structure. It is known that carbon-based materials, for example, graphite, diamond, DLC (diamond like carbon), $C_{60}$ (Fullerene), and carbon nanotubes are suitable for use in the manufacture of such flat emitters. In particular, it is believed that carbon nanotubes, with their ability to realize electron emission at relatively low driving voltages of approximately 10~50V, is the ideal emitter configuration for FEDs.

U.S. Pat. Nos. 6,062,931 and 6,097,138 disclose cold cathode field emission displays that are related to this area of FEDs, using carbon nanotube technology. The FEDs disclosed in these patents employ a triode structure having cathode electrodes, an anode electrode, and gate electrodes. During the manufacture of these FEDs, the cathode electrodes are first formed on a substrate. Then, after providing emitters on the cathode electrodes, the gate electrodes are formed on the emitters. That is, the conventional FEDs have a structure in which the gate electrodes are provided between the cathode electrodes and the anode electrode, and electrons emitted from the emitters are induced toward a phosphor layer(s).

To improve the characteristics of the FED, the above triode structure is used and the emitters are formed using a carbon-based material (i.e., carbon nanotubes). However, it is difficult to precisely form the emitters in holes formed in an insulation layer, which is provided under the gate electrodes. This is a result of the difficulties involved in forming the emitters with a printing process that uses paste. In particular, it is very difficult to provide the paste in the minute holes for formation of the emitters.

Further, with respect to the FED having the conventional triode structure, when the electrons emitted from the emitters form electron beams and travel in this state toward their intended phosphors, there are instances when an excessive diverging force of the electron beams is given by the gate electrodes when passing a region of the gate electrodes to which a positive voltage is applied. In such a case, the electron beam emitted from an emitter illuminates a phosphor adjacent to the intended phosphor as a result of the undesirable re-direction of the electron beams. This reduces color purity and overall picture quality of the FED.

SUMMARY OF THE INVENTION

An aspect of the present invention is to provide a field emission display that enables electrons emitted from emitters to land on intended phosphors without undergoing scattering.

Another aspect of the present invention is to provide a field emission display that increases electron emission levels.

Yet another aspect of the present invention is to provide a field emission display that increases the number of unit pixels within a display region.

Additional aspects and/or advantages of the invention will be set forth in part in the description which follows and, in part, will be obvious from the description, or may be learned by practice of the invention.

In one embodiment, the present invention provides a field emission display including a first substrate; at least one gate electrode formed in a first predetermined pattern on the first substrate; a plurality of cathode electrodes formed on the first substrate in a second predetermined pattern; an insulation layer formed between the at least one of gate electrode and the cathode electrodes; a plurality of emitters electrically contacting the cathode electrodes, the emitters being formed in corresponding pixel regions of the first substrate; a plurality of counter electrodes electrically connected to the at least one gate electrodes and provided such that the counter electrodes and emitters have a first predetermined gap therebetween; a second substrate provided opposing the first substrate with a second predetermined gap therebetween, the first substrate and the second substrate forming a vacuum assembly containing the emitters; at least one anode electrode formed on a surface of the second substrate opposing the first substrate; and phosphor layers formed in a third predetermined pattern on the at least one anode electrode, wherein emitter-receiving sections are provided in the cathode electrodes, dividers are formed between adjacent ones of the emitter-receiving sections, the emitters are electrically contacted with corresponding edges of the cathode electrodes corresponding to a shape of the corresponding emitter-receiving sections, and at least a part of each of the counter electrodes is provided within the corresponding emitter-receiving sections.

All of each of the counter electrodes may be provided within the corresponding emitter-receiving sections.

Further, the emitter-receiving sections may be provided at predetermined intervals along a length of the cathode electrodes, and are formed along a first long side of each of the cathode electrodes.

The emitter-receiving sections may be formed inwardly as grooves from the first long sides of the cathode electrodes. That is, the emitter-receiving sections may be formed substantially in rectangular shapes with one side of the rectangles being an imaginary line along the first long side of the cathode electrodes, or as triangles with one side of the triangles being an imaginary line along the first long side of the cathode electrodes.

The emitters may be formed along the edge of the cathode electrodes within the emitter-receiving sections on all sides of the emitter-receiving sections. Also, holes may be formed in the cathode electrodes corresponding to the locations of the emitters. Further, cutaway sections may be formed along the cathode electrodes opposite to a side whereon the emitter-receiving sections are provided.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE EMBODIMENTS

Figure 1:
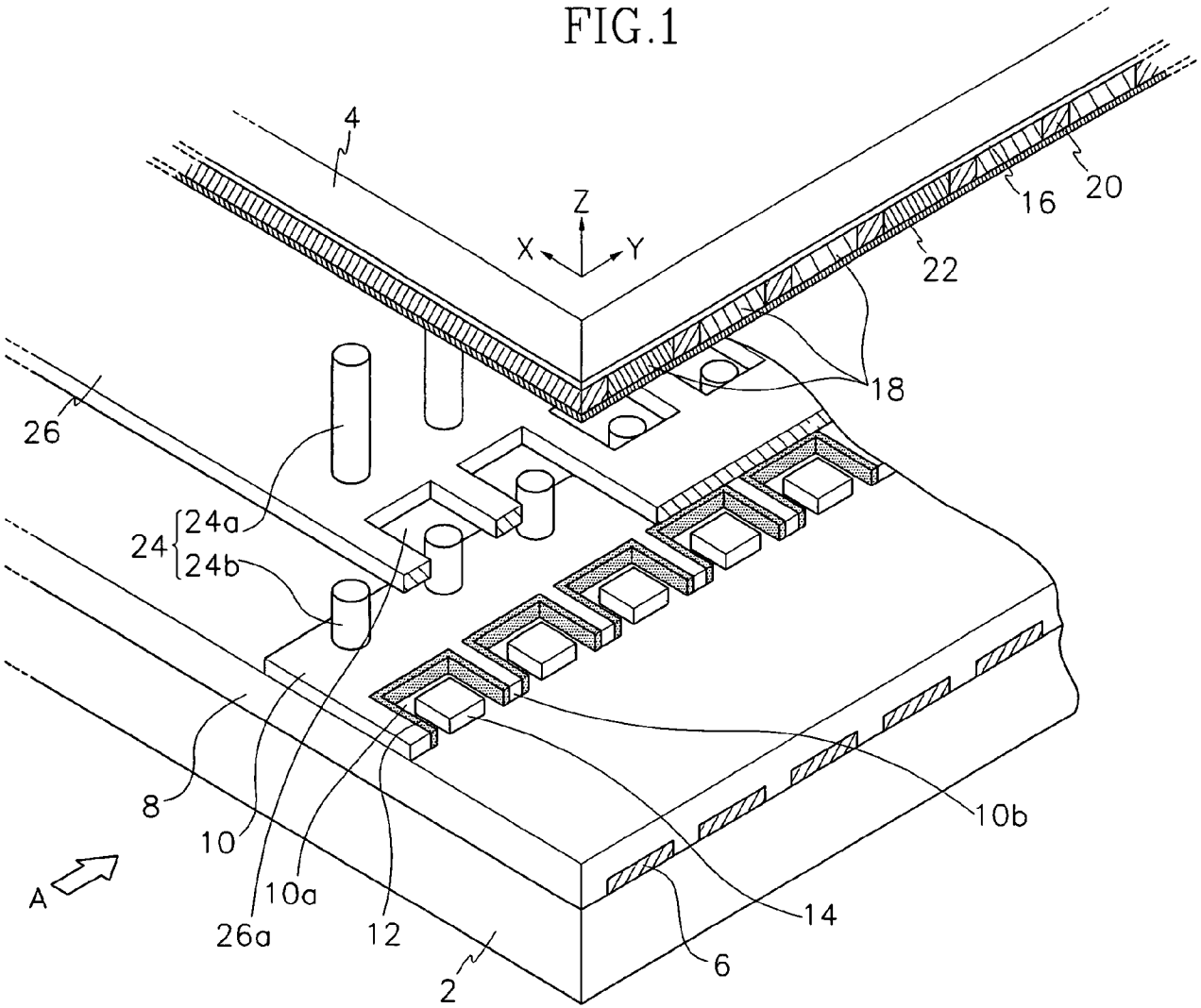
FIG. 1 is a partial exploded perspective view of a field emission display according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

Figure 2:
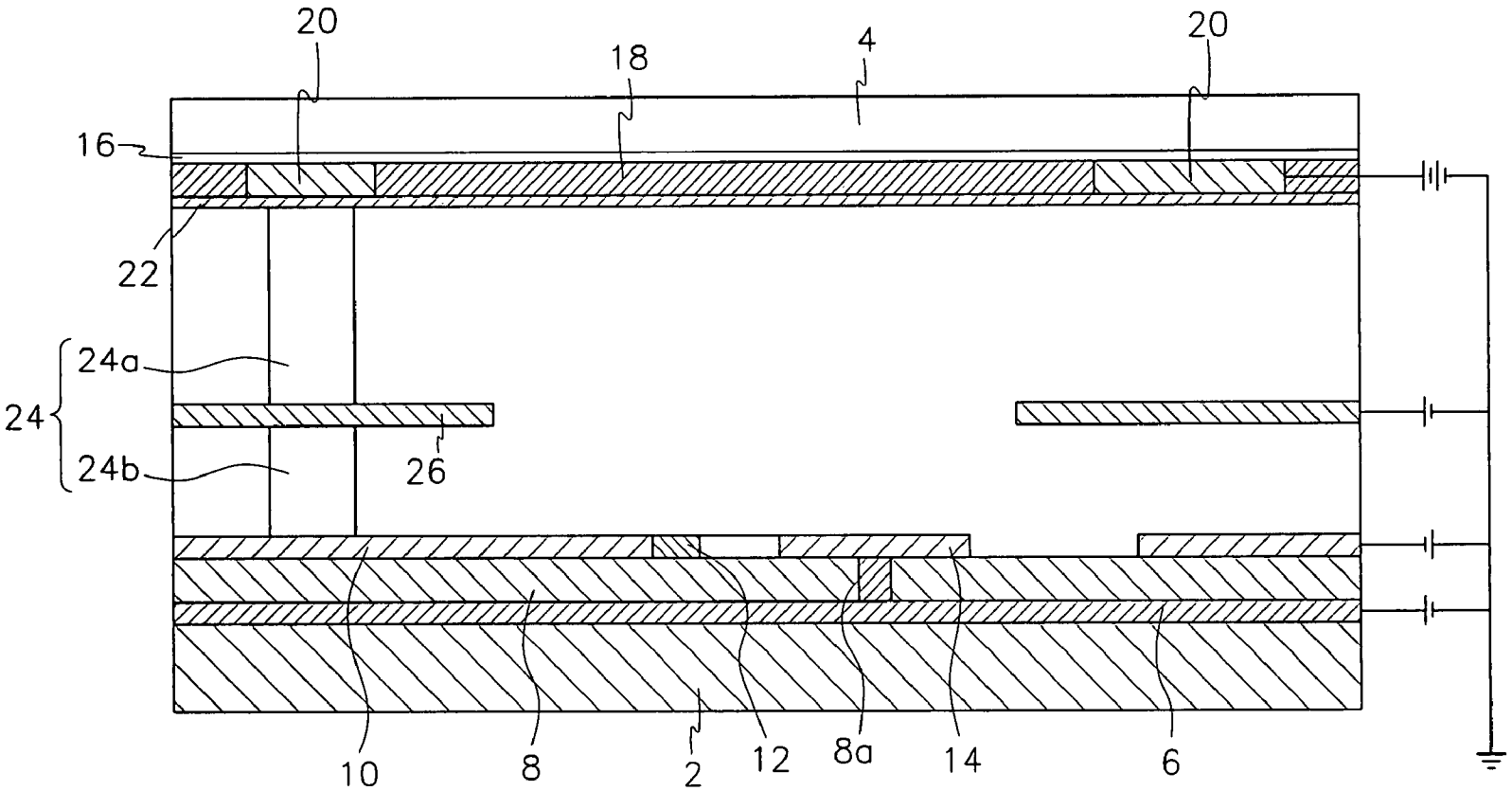
FIG. 2 is a sectional view of the field emission display of FIG. 1 shown in an assembled state.

FIG. 1 is a partial exploded perspective view of a field emission display according to an embodiment of the present invention, and FIG. 2 is a sectional view of the field emission display of FIG. 1 shown in an assembled state. FIG. 2 is shown from direction A of FIG. 1.

With reference to the drawings, the field emission display (FED) includes a first substrate 2 of predetermined dimensions (hereinafter referred to as a rear substrate) and a second substrate 4 of predetermined dimensions (hereinafter referred to as a front substrate). The front substrate 4 is provided substantially in parallel to the rear substrate 2 with a predetermined gap therebetween. The front substrate 4 and the rear substrate 2 are connected in this state to define an exterior of the FED and form a vacuum assembly.

A structure to enable the generation of electric fields is provided on the rear substrate 2. A structure to enable the realization of predetermined images by electrons emitted as a result of the generated electric fields is provided on the front substrate 4. This will be described in more detail below.

A plurality of gate electrodes 6 are formed on the rear substrate 2 in a predetermined pattern (e.g., a striped pattern), at predetermined intervals, and along an axis X direction of FIG. 1. Further, an insulation layer 8 is formed over an entire surface of the rear substrate 2 covering the gate electrodes 6. The insulation layer 8 may be made of a glass material, $SiO_2$, polyimide, nitride, a compound of these elements, or a structure in which these elements are layered. In this embodiment of the present invention, the materials used for the insulation layer 8 are transparent.

A plurality of cathode electrodes 10 are formed on the insulation layer 8 in a predetermined pattern (e.g., a striped pattern), at predetermined intervals, and along an axis Y direction of FIG. 1. Accordingly, the cathode electrodes 10 are perpendicular to the gate electrodes 6.

Further, emitters 12, which emit electrons by the generation of an electric field, are formed contacting the cathode electrodes 10 in pixel regions of the rear substrate 2. In more detail, a plurality of emitter-receiving sections 10*a* are formed along one long side (hereinafter referred to as a first long side) of each of the cathode electrodes 10 and corresponding to each of the pixel regions. In the shown embodiment, the emitter-receiving sections 10*a* are formed inwardly from the first long side of the cathode electrodes 10 to form substantially a rectangular or square shape with one of the sides being formed by an imaginary line where the first long side of the cathode electrodes 10 is removed. Also, dividers 10*b* are formed by the cathode electrodes 10 between each of the emitter-receiving sections 10*a*.

Figure 3:
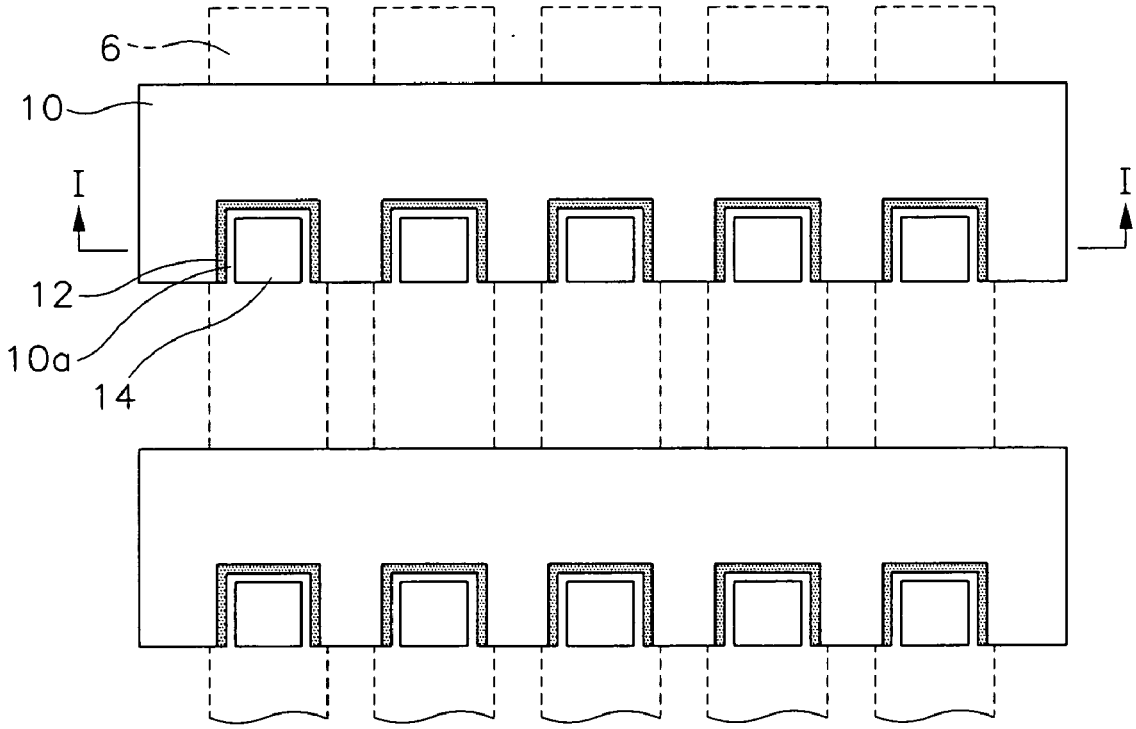
FIG. 3 is a partial plan view used to describe an emitter arrangement structure according to the embodiment of the present invention shown in FIG. 1.

The emitters 12 are formed within the emitter-receiving sections 10*a* following along three sides of the emitter-receiving sections 10*a* (not including the side formed by the first long side of the cathode electrodes 10). That is, the emitters 12 are electrically contacted with an edge of the cathode electrodes 10 corresponding to a shape of the emitter-receiving sections 10*a*. The emitters 12 are formed in this configuration to a predetermined thickness in the axis X and Y directions, as well as in an axis Z direction. The structure of the emitters 12 within the emitter-receiving sections 10*a* and their state of contact with the cathode electrodes 10 are also shown in FIG. 3.

The emitters 12 are made of a carbon-based material such as graphite, diamond, DLC (diamond like carbon), $C_{60}$ (Fullerene), or carbon nanotubes, or a combination of these elements, according to aspects of the invention. While not required, carbon nanotubes are used in a preferred embodiment of the present invention.

Formed on the insulation layer 8 are counter electrodes 14, which allow for a minimal drive voltage to be applied to the gate electrodes 6 and enable good emission of electrons from the emitters 12. During operation of the FED, a predetermined drive voltage is applied to the gate electrodes 6 to generate electric fields between the emitters 12 for the emission of electrons. The counter electrodes 14 act to form additional electric fields between themselves and the emitters 12 for the emission of electrons. At least a part of each of the counter electrodes 14 is arranged within the emitter-receiving sections 10*a*.

In this embodiment of the present invention, a portion of the counter electrodes 14 are formed in a shape corresponding to the emitter receiving sections 10*a*, that is, in a rectangular or square shape. Also, the counter electrodes 14 are positioned fully within the emitter-receiving sections 10*a* in this embodiment. A predetermined gap is maintained between the counter electrodes 14 and the emitters 12.

Figure 4:
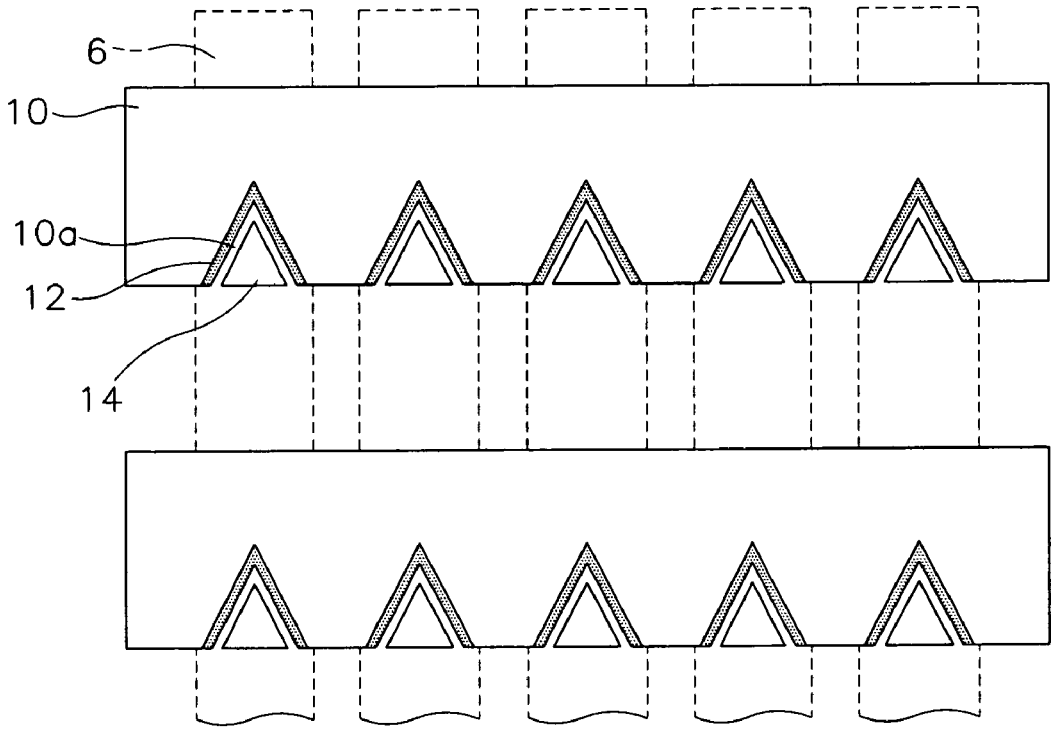
FIGS. 4, 5, 6, 7 and 9 are partial plan views used to describe an emitter arrangement structure according to other embodiments of the present invention.

As an example of another embodiment, with reference to FIG. 4, the emitter-receiving sections 10*a* are triangular with bases (or one side) formed by the first long side of the cathode electrodes 10. The emitters 12 are formed following the two sides of the triangle formed by the cathode electrodes 10, and the counter electrodes 14 are also triangular corresponding to the emitter-receiving sections 10*a*. A predetermined gap is maintained between the counter electrodes 14 and the emitters 12.

Figure 5:
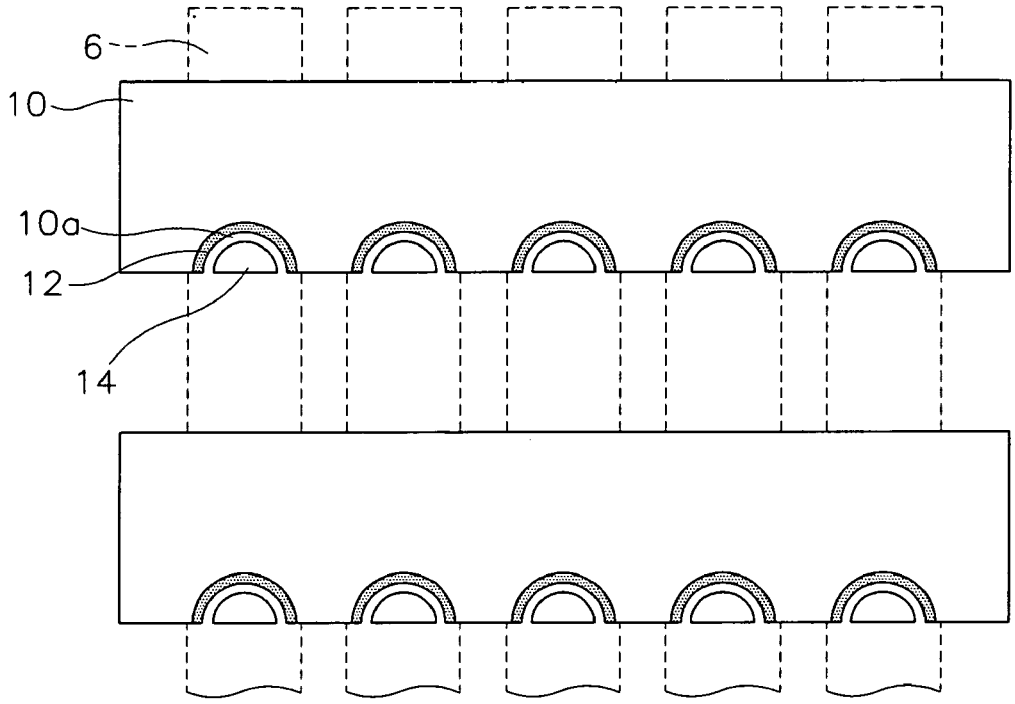
Figure 6:
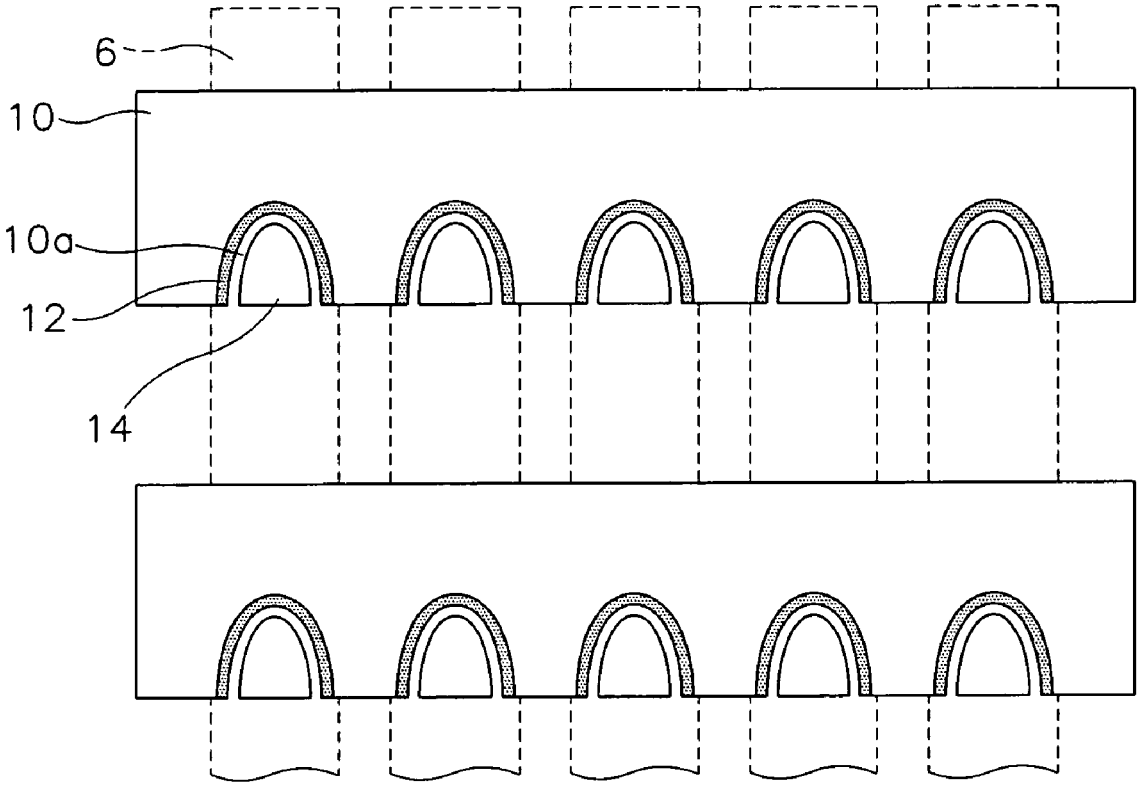

FIGS. 5 and 6 show different shapes of the emitter-receiving sections 10*a* and the counter electrodes 14, as examples of other embodiments of the present invention. As shown in FIG. 5 and FIG. 6 respectively, the emitter-receiving sections 10*a* and the counter electrodes 14 can be formed hemi-spherically or hemi-elliptically.

Figure 7:
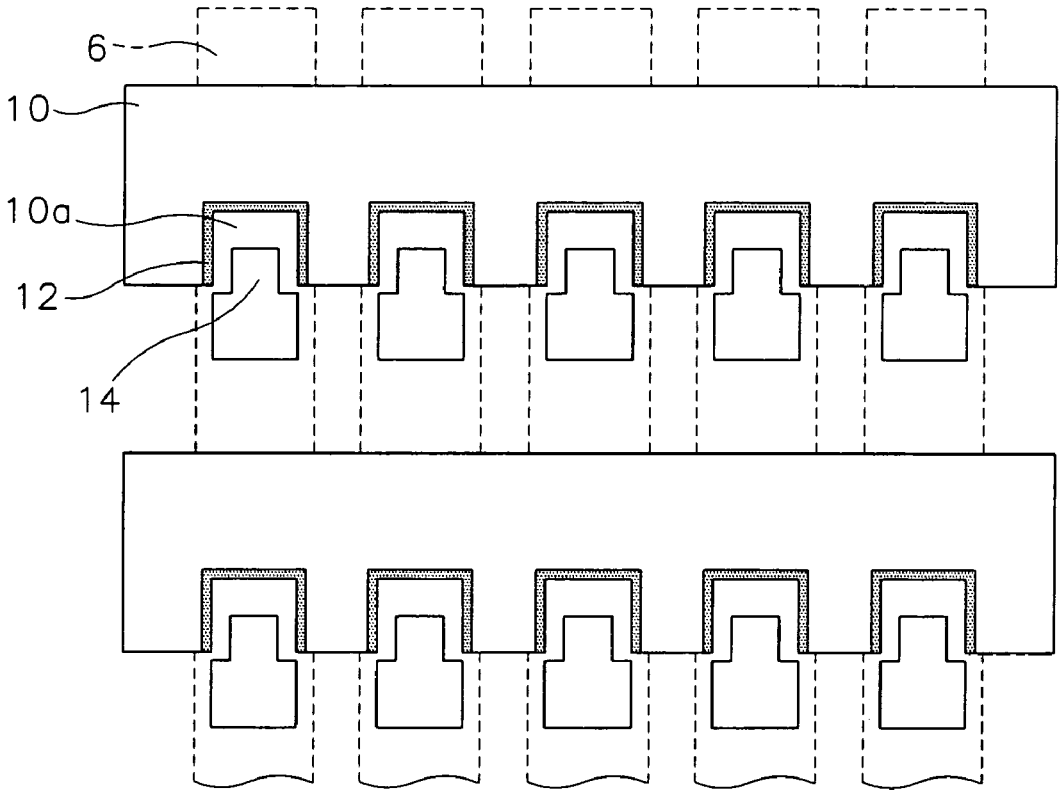

FIG. 7 shows yet another embodiment of the present invention. The emitter-receiving sections 10*a* and the emitters 12 are formed identically as in the first embodiment. The counter electrodes 14, however, are formed as rectangular or square shapes with a second (smaller) rectangular or square shape protruding from one of the sides. Only this second rectangular or square shape portion is positioned at least partially within the emitter-receiving sections 10*a*.

In all of the previously discussed embodiments, the counter electrodes 14 are electrically connected to the gate electrodes 6 to be linked to the operation of the same. To realize such a connection, holes 8*a* are formed in the insulation layer 8 as shown in FIG. 2. The counter electrodes 14 may extend into the holes 8*a* until contacting the gate electrodes 6, or other conductive material may be filled into the holes 8*a* to interconnect the counter electrodes 14 and the gate electrodes 6. The holes 8*a* are formed corresponding to the mounting positions of the counter electrodes 14 by using a printing process, a photolithography process, etc.

Formed on the front substrate 4 is an anode electrode 16 made of ITO (indium tin oxide). R,G,B phosphor layers 18 are formed at predetermined intervals along the axis X direction and corresponding to the positions of the gate electrodes 6. Also, black matrix layers 20 for improving contrast are formed on the front substrate 4 between phosphor layers 18. A metal thin film layer 22 made of aluminum or another such material is formed on the phosphor layers 16 and the black matrix layers 20. The metal thin film layer 22 aids in improving the voltage withstanding characteristics and brightness characteristics of the FED.

The rear substrate 2 and the front substrate 4 are provided substantially in parallel with a predetermined gap therebetween as described above, and in a state where the cathode electrodes 10 are perpendicular to the phosphor layers 18. The rear and front substrates 2 and 4 are sealed using a sealant such as frit, which is applied around a circumference of the surfaces of the rear and front substrates 2 and 4 facing each other. The space between the rear and front substrates 2 and 4 is evacuated to realize a vacuum state therebetween. Also, spacers 24 are provided between the rear and front substrates 2 and 4 at non-pixel regions. The spacers 24 maintain the predetermined gap between the rear and front substrates 2 and 4 uniformly over the entire area of these two elements. In this embodiment of the present invention, the spacers 24 include upper spacers 24*a* for supporting the front substrate 4 and lower spacers 24*b* for supporting the rear substrate 2.

In addition, a mesh grid 26 having a plurality of holes 26*a* is mounted between the upper spacers 24*a* and the lower spacers 24*b*. The mesh grid 26 prevents damage to the cathode electrodes 10 in the case where arcing occurs within the display, and acts to focus the electron beams formed by the emission of electrons by the emitters 12. In this embodiment of the present invention, the holes 26*a* of the mesh grid 26 correspond to the pixels of the rear substrate 2. However, the holes 26*a* may also be arranged in a non-uniform manner without corresponding to the locations of the pixels.

In the FED structured as discussed above, with the application of predetermined voltages to the gate electrodes 6, the cathode electrodes 10, the anode electrode 16, and the mesh grid 26 (from a few to a few tens of positive volts to the gate electrodes 6, from a few to a few tens of negative volts to the cathode electrodes 10, from a few hundred to a few thousand of positive volts to the anode electrode 16, and from a few tens to a few hundreds of positive volts to the mesh grid 26), electric fields are generated between the gate electrodes 6 and the cathode electrodes 10 such that electrons are emitted from the emitters 12. The emitted electrons are formed into electron beams and induced toward the phosphor layers 18 to strike the same, and the phosphor layers 18 are illuminated as a result to realize predetermined images.

Figure 8:
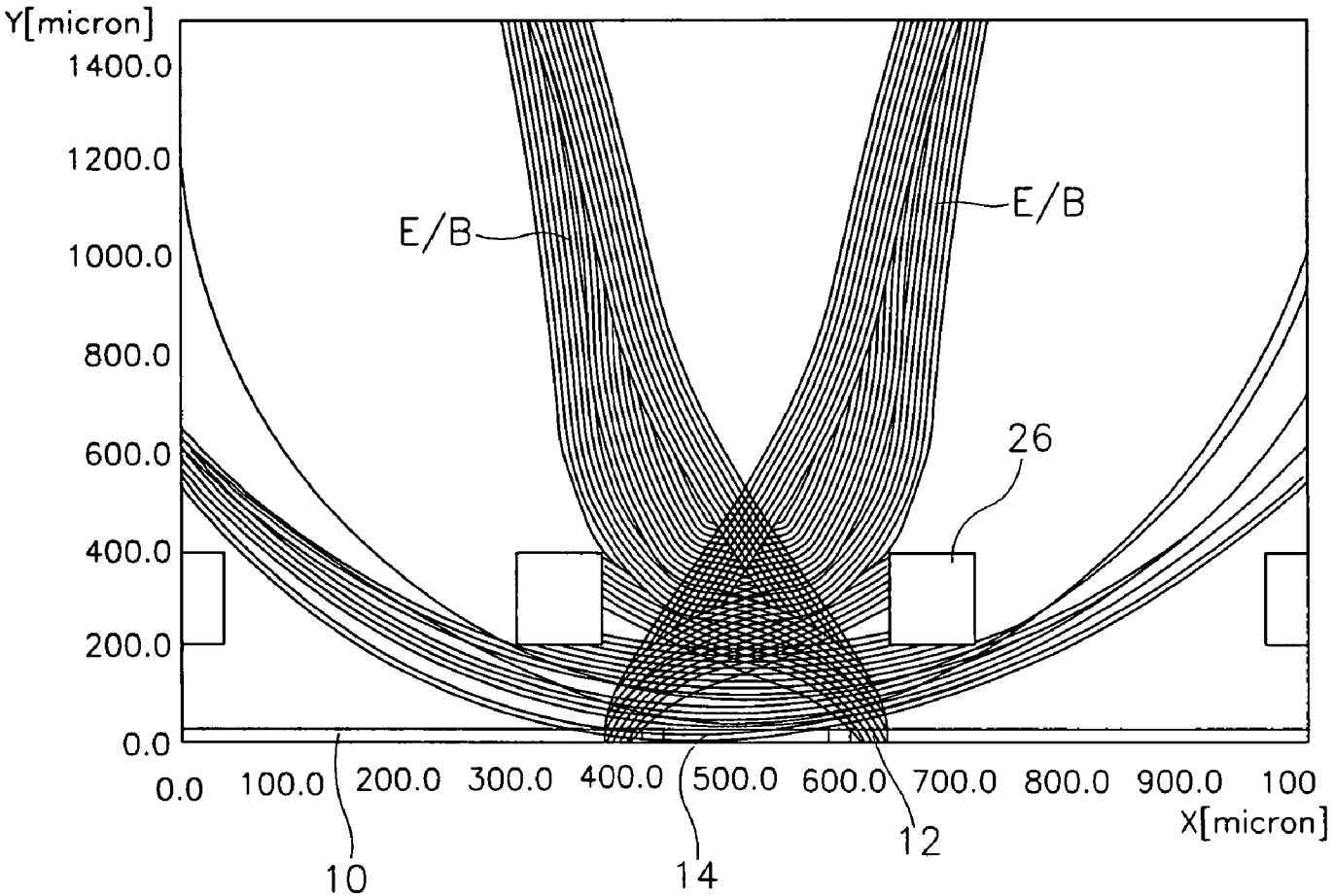
FIG. 8 shows results of a computer simulation illustrating paths of electron beams emitted from emitters of a field emission display according to the embodiment of the present invention show in FIG. 1.

FIG. 8 shows results of a computer simulation illustrating traces of electron beams emitted from the emitters 12 in the FED structured as described above. The level of emission of the electrons toward the phosphor layers 18 may be determined from the simulation result. The simulation is taken from the view along line I-I of FIG. 3.

It is clear from the simulation result of FIG. 8 that electrons are emitted from the front, left, and right sides of the counter electrodes 14, as well as from the three sides of the emitters 12 provided within the emitter-receiving sections 10*a*. These electrons are then formed into electron beams E/B and directed toward the phosphor layers 18. Hence, the amount of electrons emitted from the pixel regions is increased as a result of the electron emission occurring from three directions.

With the increase in electron emission amounts, the phosphor layers 18 are illuminated by a larger number of electrons such that the brightness is increased. Further, the structure of the three sides of the counter electrodes 14 being surrounded by the emitters 12 is such that the electron beams E/B are better focused.

In addition, since the counter electrodes 14 are mounted fully or partially within the emitter-receiving sections 10*a* as described above, the area needed to form the counter electrodes 14 on the rear substrate 2 may be reduced. Therefore, the number of pixels on the rear substrate 2 may be increased to thereby enhance resolution.

In sum, by improving the arrangement structure of the emitters 12 on the cathode electrodes 10 in the present invention, electron emission characteristics are enhanced. This, in turn, improves the brightness, lifespan, and reliability of the emitters.

Also, the width, length, and overall shape of the emitters, and/or the distance between the emitters and the counter electrodes, may be changed in various ways to optimize the scanning of the electron beams (i.e., to prevent scattering of the electron beams).

Figure 9:
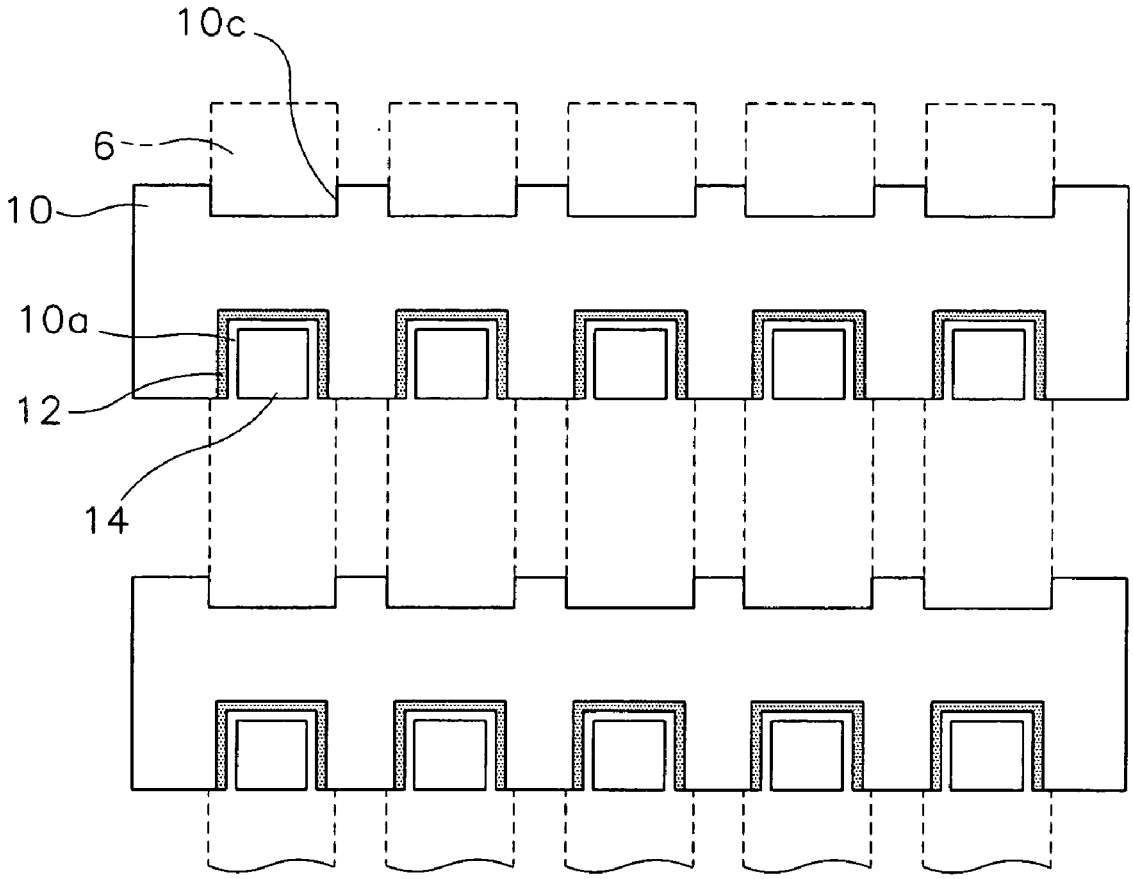

With reference to FIG. 9, cutaway sections 10*c* may be formed along long sides (hereinafter referred to as second long sides) of the cathode electrodes 10 opposite the first long sides. The cutaway sections 10*c* are formed at locations corresponding to the emitter-receiving sections 10*a* along the axis Y direction, and are formed inwardly from the second long sides as substantially rectangular shapes. During operation of the FED, the distribution of the formed electric fields is improved by the cutaway sections 10*a* such that the strength of the electric fields is increased, thereby further optimizing the scanning of the electron beams. The size and shape of the cutaway sections 10*a* may be altered depending the characteristics of the FED to which the structure is applied.

Figure 10:
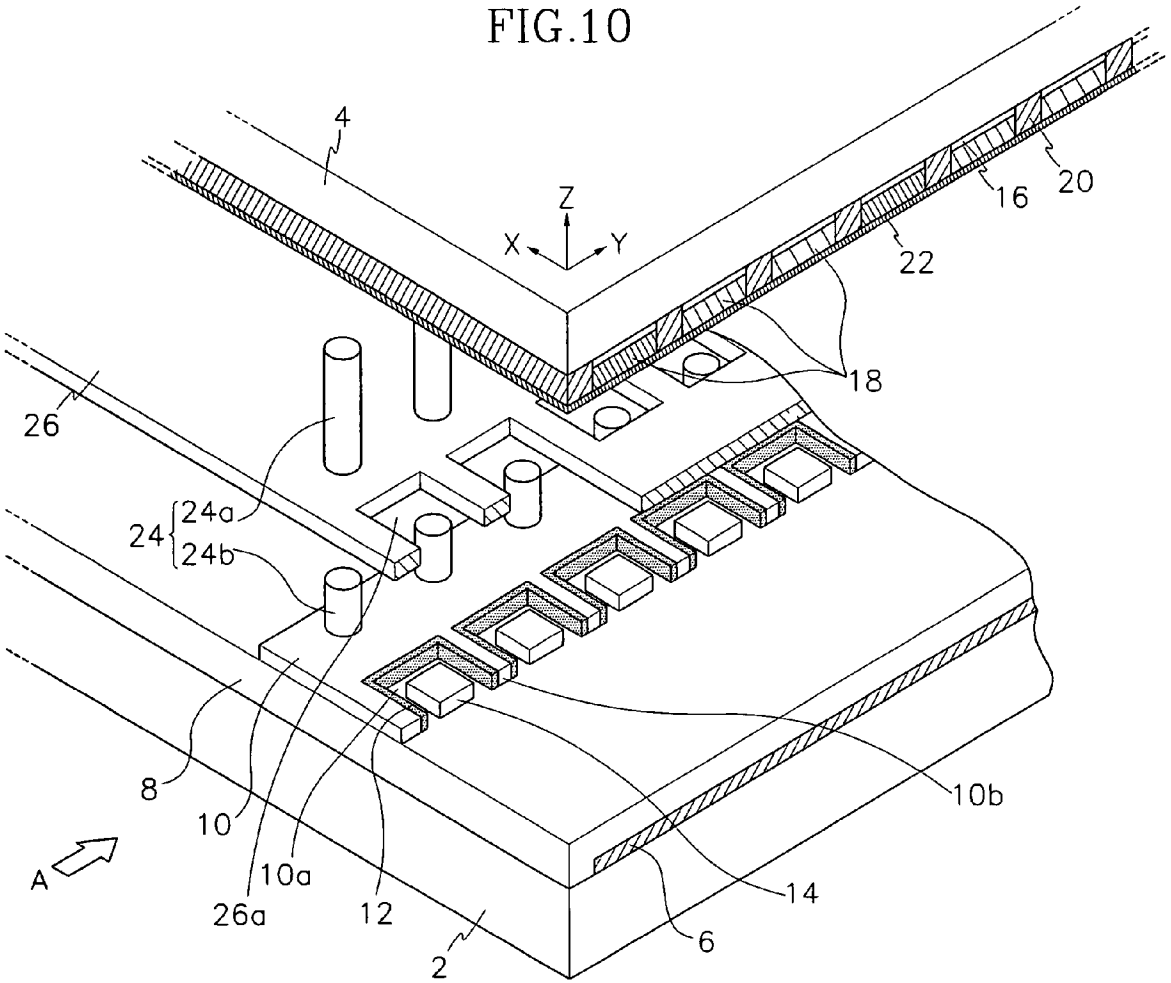
FIG. 10 is a partial exploded perspective view of a field emission display according to another embodiment of the present invention.
Figure 11:
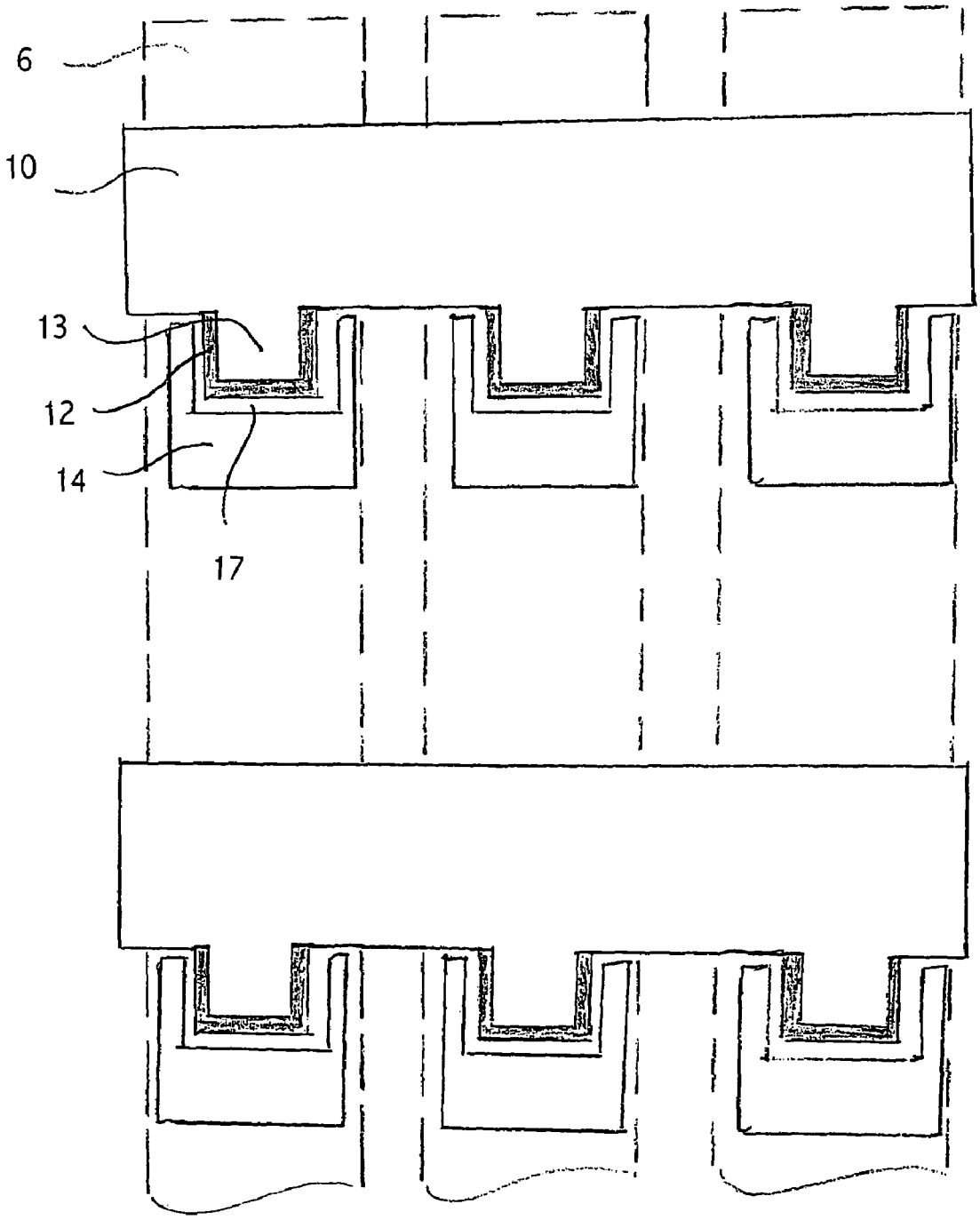
FIGS. 11-14 are partial plan views used to describe an emitter arrangement structure according to still other embodiments of the present invention.
Figure 12:
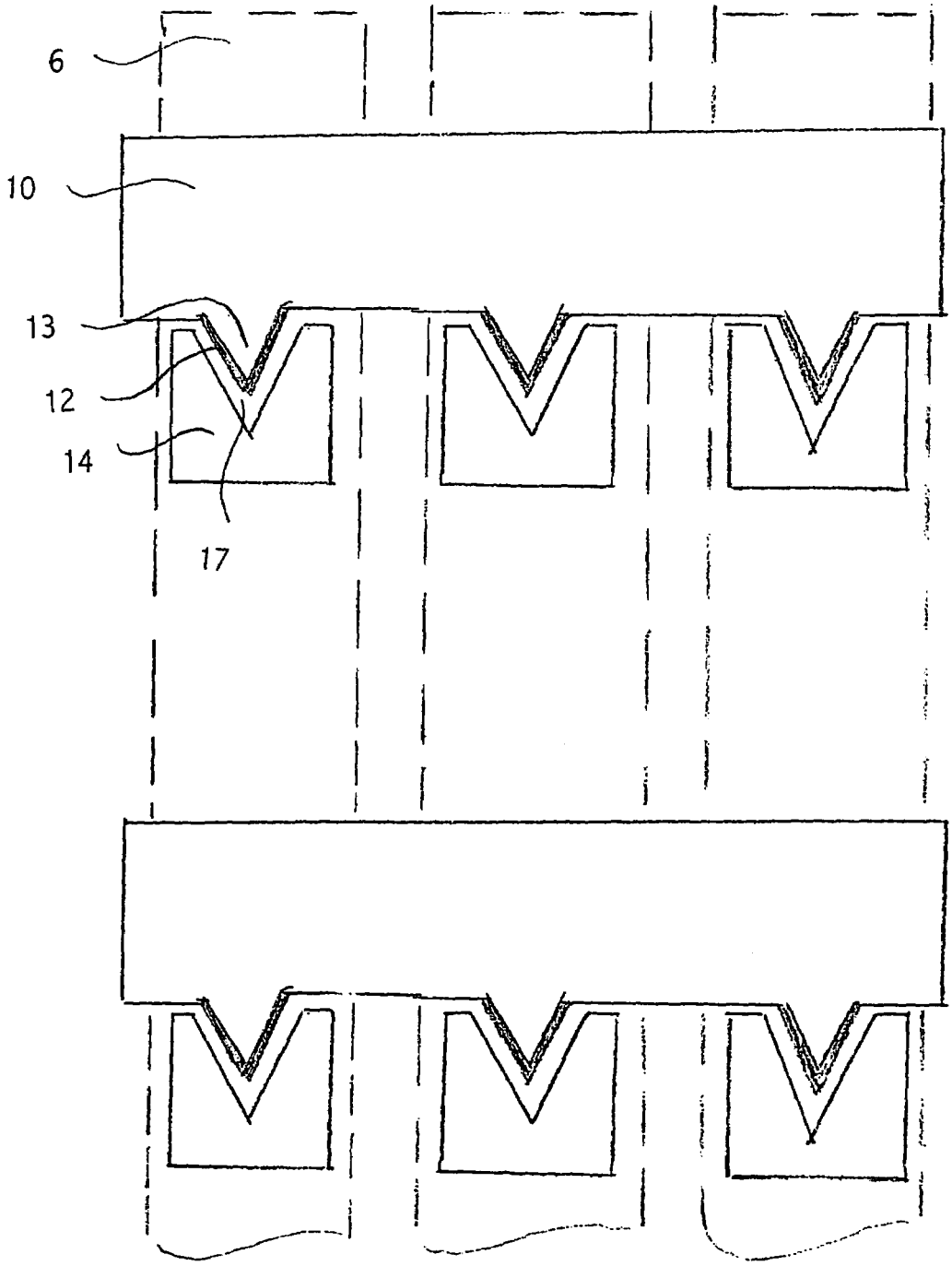
Figure 13:
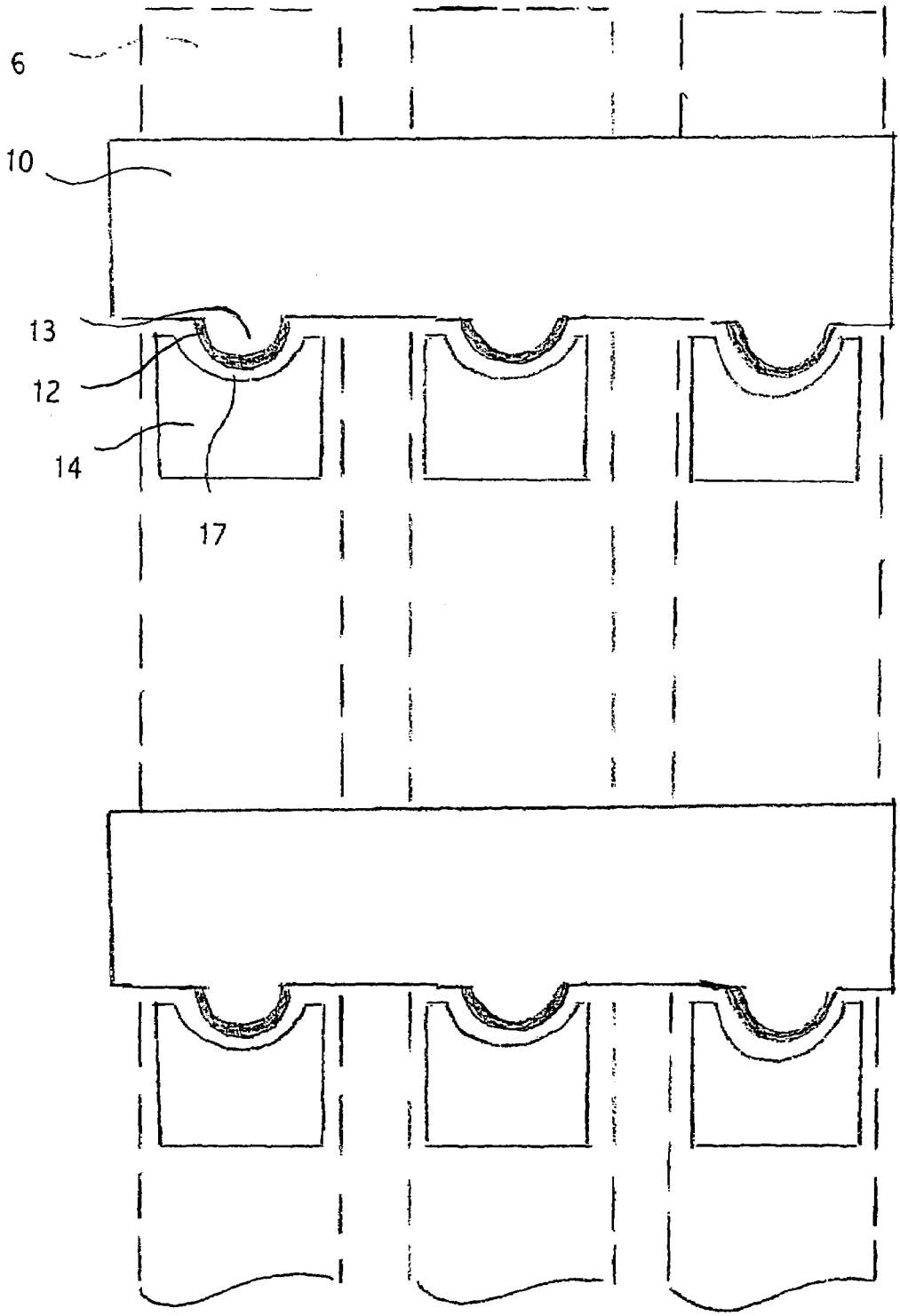
Figure 14:
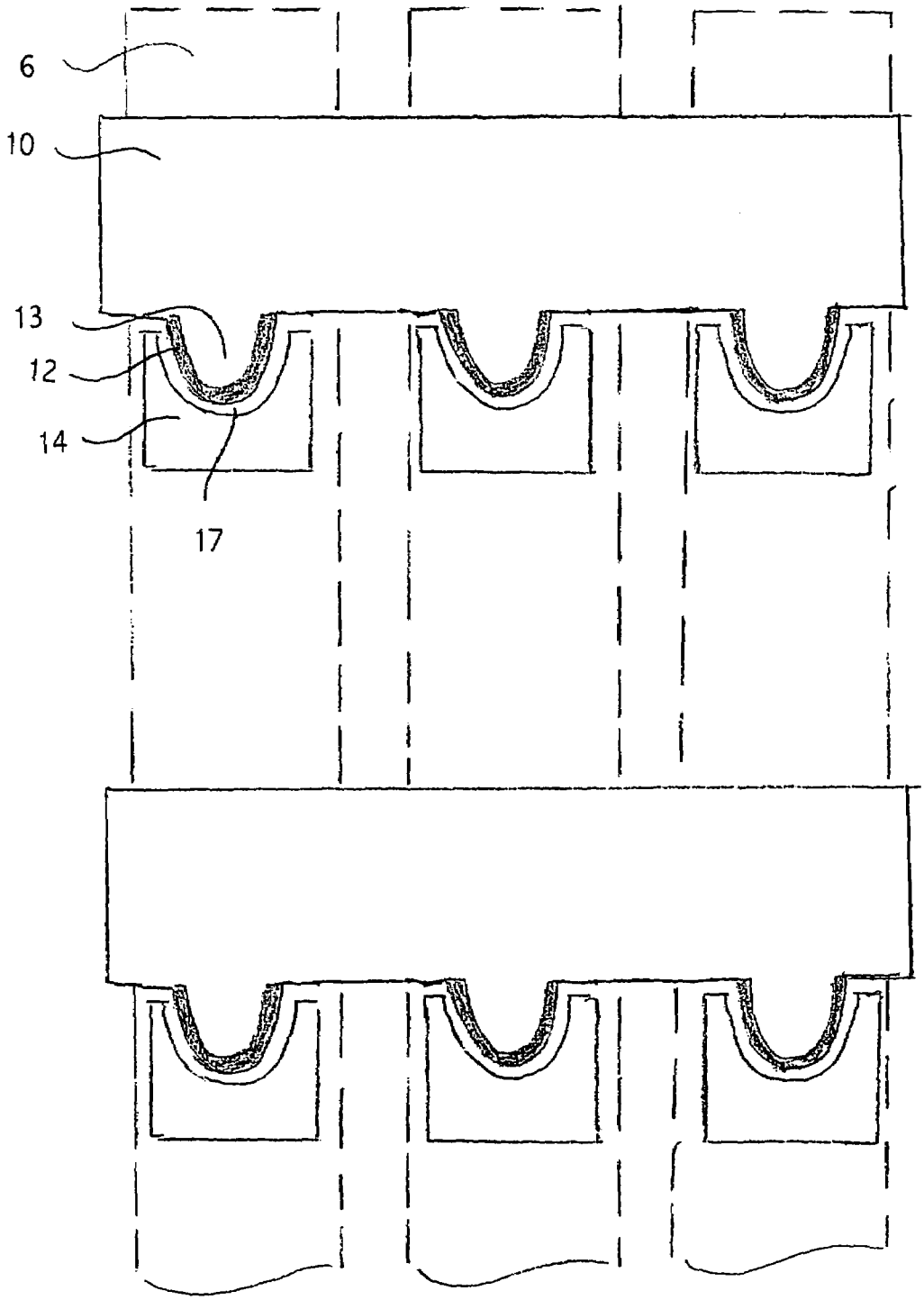

Those skilled in the art can appreciate that further embodiments of the present field emission display invention can be implemented. Referring to FIG. 10, for example, at least one anode electrode 16 can be formed in a striped pattern, while having one gate electrode 6 function as the common electrode.

The remaining portions and their functions would be as described above for FIG. 1. Those skilled in the art would then appreciate that the cathode electrodes could receive scanning information while the anode electrodes receive the data information and vice versa.

Still other alternative embodiments of the present invention are shown in FIGS. 11-14, in which the cathode electrodes 10 have a plurality of convex portions 13 formed along the first long sides of each of the cathode electrodes 10 with a predetermined distance therebetween, and corresponding to each of the pixel regions. The emitters 12 are formed along, and are electrically contacted to, the corresponding edges of the convex portions 13. The plurality of counter electrodes 14 have a concave portion 17 corresponding to the convex portions 13 of the cathode electrode. Each of FIGS. 11-14 show an embodiment with different shapes of the convex portions 13 of the cathode electrodes 10 and the concave portions 17 of the counter electrodes 14. However, it is understood that other shapes can be used for the portions 13 and 17.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A field emission display, comprising:

a first substrate;

at least one gate electrode formed in a predetermined pattern on the first substrate;

a plurality of cathode electrodes formed on the first substrate in a predetermined pattern;

an insulation layer formed between the at least one gate electrode and the cathode electrodes;

a plurality of emitters electrically contacting the cathode electrodes, the emitters being formed in corresponding pixel regions of the first substrate;

a plurality of counter electrodes electrically connected to the at least one gate electrode and provided such that the counter electrodes and emitters have a predetermined gap therebetween;

a second substrate provided opposing the first substrate with a predetermined gap therebetween, the first substrate and the second substrate forming a vacuum assembly containing the emitters;

at least one anode electrode formed on a surface of the second substrate opposing the first substrate; and phosphor layers formed in a predetermined pattern on the at least one anode electrode;

wherein emitter-receiving sections are provided in the cathode electrodes, dividers are formed between adjacent ones of the emitter-receiving sections, the emitters are electrically contacted with corresponding edges of the cathode electrodes corresponding to a shape of the corresponding emitter-receiving sections, and at least a part of each of the counter electrodes is provided within the corresponding emitter-receiving sections.

2. The field emission display of claim 1, wherein the entirety of each of the counter electrodes is provided within the corresponding emitter-receiving sections.

3. The field emission display of claim 1, wherein the emitter-receiving sections are provided at predetermined intervals along a length of the cathode electrodes.

4. The field emission display of claim 3, wherein the emitter-receiving sections are formed along a first long side of each of the cathode electrodes.

5. The field emission display of claim 4, wherein the emitter-receiving sections are formed inwardly as grooves from the first long sides of the cathode electrodes.

6. The field emission display of claim 5, wherein a shape of the counter electrodes positioned within the emitter-receiving sections corresponds to the emitter-receiving sections.

7. The field emission display of claim 6, wherein the emitter-receiving sections are formed substantially in rectangular shapes with one side of the rectangles being an imaginary line along the first long side of the cathode electrodes.

8. The field emission display of claim 6, wherein the emitter-receiving sections are formed substantially as triangles with one side of the triangles being an imaginary line along the first long side of the cathode electrodes.

9. The field emission display of claim 5, wherein the emitters are formed along the edge of the cathode electrodes within the emitter-receiving sections on all sides of the emitter-receiving sections.

10. The field emission display of claim 1, wherein the counter electrodes are connected to the gate electrodes through holes formed in the insulation layer.

11. The field emission display of claim 1 wherein the emitters comprise a carbon-based material.

12. The field emission display of claim 11, wherein the carbon-based material comprises at least one of carbon nanotubes, C60 (Fullerene), diamond, diamond-like carbon (DLC), graphite, or a mixture of these elements.

13. The field emission display of claim 1, wherein holes are formed in the cathode electrodes corresponding to locations of the emitters.

14. The field emission display of claim 1, wherein cutaway sections are formed along the cathode electrodes opposite to a side whereon the emitter-receiving sections are provided.

15. The field emission display of claim 1, further comprising a mesh grid mounted between the cathode electrodes and the at least one anode electrode.

16. The field emission display of claim 6, wherein the emitter-receiving sections are formed substantially as hemispheres.

17. The field emission display of claim 6, wherein the emitter-receiving sections are formed substantially as hemiellipses.

18. A substrate for use in a field emission display, comprising:

a gate electrode;

a plurality of cathode electrodes;

a plurality of emitters electrically contacting the cathode electrodes; and a plurality of counter electrodes electrically connected to the gate electrode, and provided such that a predetermined gap exists between the counter electrodes and the emitters;

wherein the emitters are formed along edges of inwardly formed sections formed in the cathode electrodes, and at least part of each of the counter electrodes is provided within the corresponding sections.

19. A substrate for use in a field emission display, comprising:

a plurality of cathode electrodes having inwardly formed sections extending into the cathode electrodes in a direction parallel to the substrate from one side of the cathode electrodes that is perpendicular to the substrate; and a plurality of emitters electrically contacting the cathode electrodes;

wherein the inwardly formed sections have sides that are perpendicular to the substrate; and wherein the emitters are formed only on the sides of the inwardly formed sections that are perpendicular to the substrate.

20. The substrate of claim 19, wherein the emitters are the only emitters electrically contacting the cathode electrodes;

wherein the cathode electrodes have a length extending in a first direction parallel to the substrate, a width less than the length and extending in a second direction parallel to the substrate and perpendicular to the first direction, and a thickness less than the length and the width and extending in a third direction perpendicular to the substrate and perpendicular to the first direction and the second direction;

wherein the cathode electrodes have a first surface that is parallel to the substrate, and a second surface that is parallel to the substrate and is separated from the first surface by the thickness of the cathode electrodes;

wherein the one side of the cathode electrodes from which the inwardly formed sections extend into the cathode electrodes connects the first surface of the cathode electrodes to the second surface of the cathode electrodes;

wherein the inwardly formed sections have a depth extending in the third direction perpendicular to the substrate that is equal to the thickness of the cathode electrodes; and wherein all sides of the inwardly formed portions are perpendicular to the substrate.

21. An emitter assembly for use in a field emission display, comprising:

a cathode disposed on a layer and having an inwardly formed section;

an emitter disposed on edges of the inwardly formed section; and a counter electrode disposed on the layer;

wherein at least a part of the counter electrode is disposed in the inwardly formed section between opposing edges of the emitter.

22. The emitter assembly of claim 21, wherein the part of the counter electrode disposed in the inwardly formed section is shaped substantially the same as the inwardly formed sections.

23. The emitter assembly of claim 21, wherein the inwardly formed section is in a rectangular shape.

24. The emitter assembly of claim 21, wherein the inwardly formed section is in a triangular shape.

25. The emitter assembly of claim 21, wherein the inwardly formed section is in a hemispherical shape.

26. The emitter assembly of claim 21, wherein the inwardly formed section is in a hemi-elliptical shape.

27. An emitter assembly for use in a field emission display, comprising:

a cathode disposed on a layer and having an outwardly formed section;

an emitter disposed on edges of the outwardly formed section of the cathode;

a counter electrode disposed on the layer; and wherein the counter electrode has an inwardly formed section to receive the outwardly formed section of the cathode.

28. The emitter assembly of claim 27, wherein a shape of the inwardly formed section of the counter electrode corresponds to the outwardly formed section of the cathode.

29. The emitter assembly of claim 27, wherein the outwardly formed section is in a rectangular shape.

30. The emitter assembly of claim 27, wherein the outwardly formed section is in a triangular shape.

31. The emitter assembly of claim 27, wherein the outwardly formed section is in a hemispherical shape.

32. The emitter assembly of claim 27, wherein the outwardly formed section is in a hemi-elliptical shape.

33. The emitter assembly of claim 27, wherein a first surface of the cathode parallel to the layer lies entirely within a same first plane as a first surface of the counter electrode parallel to the layer; and wherein a second surface of the cathode parallel to the layer lies entirely within a same second plane as a second surface of the counter electrode parallel to the layer, the second plane being different from the first plane and being parallel to the first plane.

34. A substrate for use in a field emission display, comprising:

a plurality of cathode electrodes having outwardly formed sections protruding in a direction parallel to the substrate from one side of the cathode electrodes that is perpendicular to the substrate; and a plurality of emitters electrically contacting the cathode electrodes;

wherein the outwardly formed sections have sides that are perpendicular to the substrate; and wherein the emitters are formed only on the sides of the outwardly formed sections that are perpendicular to the substrate.

35. The substrate of claim 34, wherein the emitters are the only emitters electrically contacting the cathode electrodes;

wherein the cathode electrodes have a length extending in a first direction parallel to the substrate, a width less than the length and extending in a second direction parallel to the substrate and perpendicular to the first direction, and a thickness less than the length and the width and extending in a third direction perpendicular to the substrate and perpendicular to the first direction and the second direction;

wherein the cathode electrodes have a first surface that is parallel to the substrate, and a second surface that is parallel to the substrate and is separated from the first surface by the thickness of the cathode electrodes;

wherein the one side of the cathode electrodes from which the outwardly formed sections protrude connects the first surface of the cathode electrodes to the second surface of the cathode electrodes;

wherein the outwardly formed sections have a thickness extending in the third direction perpendicular to the substrate that is equal to the thickness of the cathode electrodes; and wherein all sides of the outwardly formed portions are perpendicular to the substrate.

36. A substrate for use in a field emission display, comprising:

a gate electrode;

a plurality of cathode electrodes;

a plurality of emitters electrically contacting the cathode electrodes; and a plurality of counter electrodes electrically connected to the gate electrode, and provided such that a predetermined gap exists between the counter electrodes and the emitters;

wherein the emitters are formed along edges of outwardly formed sections formed on the cathode electrodes, and the counter electrodes have inwardly formed sections to receive at least part of the corresponding outwardly formed sections of the cathode electrodes.

* * * * *